US007329069B2

(12) United States Patent
Slater et al.

(10) Patent No.: US 7,329,069 B2
(45) Date of Patent: Feb. 12, 2008

(54) SECTIONAL INTERLOCKING BARRIER BAGS

(76) Inventors: Steve A. Slater, 9121 1/2 Airdrome St., Los Angeles, CA (US) 90035; Peter D. Ehrlich, 3586 Wesley St., Culver City, CA (US) 90232

( * ) Notice: Subject to any disclaimer, the term of this patent is extended or adjusted under 35 U.S.C. 154(b) by 101 days.

(21) Appl. No.: 10/564,171

(22) PCT Filed: Jul. 11, 2003

(86) PCT No.: PCT/US03/21770

§ 371 (c)(1),
(2), (4) Date: Jan. 10, 2006

(87) PCT Pub. No.: WO2005/005807

PCT Pub. Date: Jan. 20, 2005

(65) Prior Publication Data

US 2006/0210360 A1 Sep. 21, 2006

(51) Int. Cl.
*E02B 7/00* (2006.01)

(52) U.S. Cl. ..... 405/114; 405/116; 405/18; 405/16; 383/32

(58) Field of Classification Search ..... 405/302.6, 405/302.7, 15–18, 21, 107, 111, 114–116; 383/32
See application file for complete search history.

(56) References Cited

U.S. PATENT DOCUMENTS 3,374,635 A 3/1968 Crandall
3,396,542 A 8/1968 Lamberton
3,474,626 A 10/1969 Colle
3,561,219 A 2/1971 Nishizawa et al.
3,696,623 A 10/1972 Heine et al.
3,886,751 A 6/1975 Labora
3,957,098 A 5/1976 Hepworth et al.
4,102,137 A 7/1978 Porraz et al.
4,135,843 A 1/1979 Umemoto et al.
4,184,788 A 1/1980 Colle
4,362,433 A 12/1982 Wagner et al.
4,449,847 A 5/1984 Scales et al.
4,889,446 A 12/1989 Holmberg
4,981,392 A 1/1991 Taylor
5,669,732 A 9/1997 Truitt
5,857,806 A 1/1999 Melin
5,971,661 A 10/1999 Johnson et al.
6,126,362 A 10/2000 Carter et al.
6,428,240 B1 * 8/2002 Ehrlich et al. ..... 405/114
6,619,884 B2 * 9/2003 Davis et al. ..... 405/111
7,029,205 B2 * 4/2006 Daigle ..... 405/302.6

* cited by examiner

*Primary Examiner*—Frederick L. Lagman
(74) *Attorney, Agent, or Firm*—Lewis Brisbois Bisgaard & Smith LLP; Sanford Astor

(57) ABSTRACT

A bag made from a length of material (10) divided into a series of three or more substantially equal sized sections (12, 14, 16, 18, 20). Every other section is filled with sand (14, 18), or other particulate material and there is an unfilled section (12, 20) at each end.

20 Claims, 3 Drawing Sheets

SECTIONAL INTERLOCKING BARRIER BAGS

TECHNICAL FIELD

The invention relates to bags used to provide a barrier. The barrier may prevent the passage of liquid, water, mud and silt during a flood or for other fluid flow problems. The barrier may also be used to protect against the collapse of dry sand or earth for below-grade retaining walls and trenching, or for the purpose of protection from gunfire explosive blasts and shrapnel, etc. in military applications.

BACKGROUND ART

The invention described herein has improvements over the bag system described in our issued U.S. Pat. No. 6,428,240. The improvements are discussed below.

Sandbags now in use are difficult to keep stacked, and they do not provide a stable structure when stacked or piled. Suggestions have been made to provide a method for stacking bags, such as in U.S. Pat. No. 3,374,635 where rounded bags are tied together with lashing. However, as can be clearly seen, there are gaping spaces between the stacked bags, allowing considerable water to pass through the stacked bags.

Another suggested method is shown in U.S. Pat. No. 3,886,751 using complex shaped bags, which have a protuberance which fits into an indentation in an adjoining bag. This method is very inefficient because the protuberances do not maintain their integrity on site. The bags also require steel rods to hold open a second filler protuberance. These fillers can get easily clogged and the bags can get easily misshapen so that they do not fit together.

DISCLOSURE OF INVENTION

Applicants' invention comprises a length of material, such as canvas, woven polyethylene, woven polypropylene, burlap, ballistic nylon, woven organic fibers or other material, divided into a unit having a series of two or more substantially equal sized sections. Every other section is filled with particulate, such as sand, or other equivalent material, and every unit has an unfilled end-flap at both ends. When multiple sections are put in place, each row with an alternating filled section and an unfilled section, and stacked in layers, there is created a very secure, substantially water-tight structure. Because each section is substantially square, the sections can be stacked in a parallel or transverse direction, to effect a wider and stronger water-fight structure. The sections interlock to attain greater strength and water flow prevention. By having an unfilled section at both ends of each unit, the bag units are reversible or bi-directional. That is, they may be stacked in any direction, parallel or transverse, in either direction, and no time needs to be spent in making sure they are stacked correctly.

In addition, there is a great need for a field-fillable bag, that is, a bag that is not filled with sand, or other material, until it is used in the field. Applicants have provided an improved bag which is easily and quickly fillable in the field and easily and quickly sealed after it has been filled.

BEST MODE FOR CARRYING OUT THE INVENTION

Figure 1:
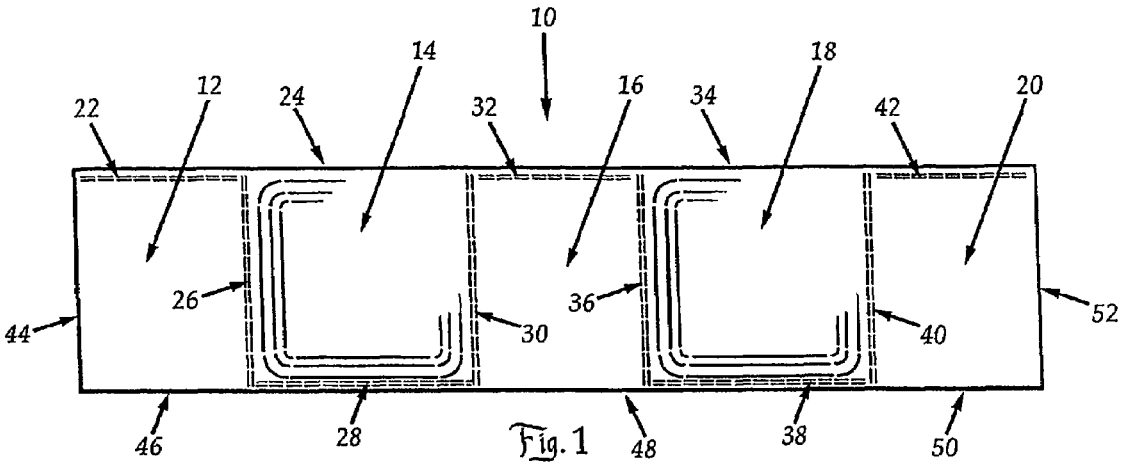
FIG. 1 is a top plan view of the bag structure of this invention.
Figure 2:
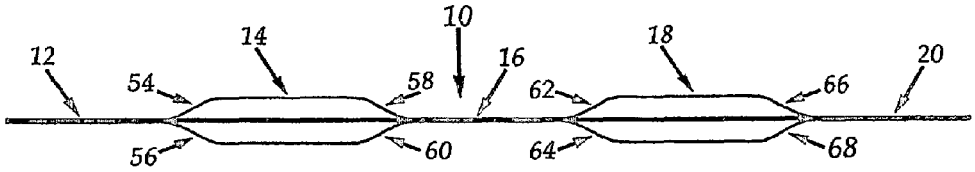
FIG. 2 is a side elevational view.
Figure 3:
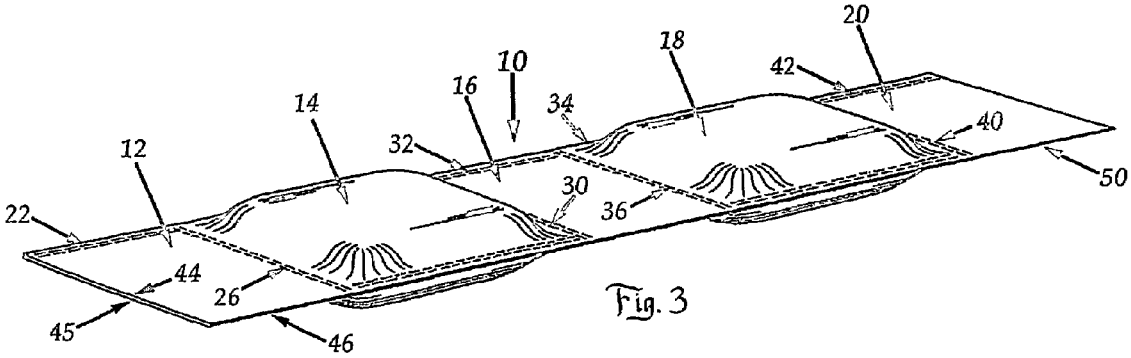
FIG. 3 is a perspective view.

Referring now to the drawings, there is shown in FIGS. 1-3 a length of material 10, such as canvas, woven polyethylene, woven polypropylene, burlap, ballistic nylon, woven organic fibers or other material, formed into a single bag unit by folding over the material 10 lengthwise into two equal-sized lengths and dividing the folded material into substantially equal-sized, square sections 12, 14, 16, 18 and 20. Sections 14 and 18 are filled with sand, or another material, and sections 12, 16 and 20 are unfilled. The sections are divided and sealed along dotted lines 22, 24, 26, 28, 30, 32, 34, 36, 38, 40 and 42, by any method of sealing the sections apart, such as heat, sewing, clamping, stapling or adhesive. Since material 10 is folded over lengthwise, there is no need to seal the material at edges 44, 46, 48, 50 and 52. However, if desired, these edges can also be sealed by any of the same methods. FIG. 3 shows the material 10 folded over into two equal lengthwise portions at edges 44, 45.

While using a single piece of material and folding it over to form the bag units is the easiest and most secure method of forming the bag units, it is also possible to use two separate pieces of material and attach them together by any of the aforementioned methods, such as sewing.

As shown in FIGS. 1-3, edges 24 and 34 are sealed by adhesive, as explained below, while the other sealed edges are sealed by sewing, clamping, stapling, or adhesive, as shown by the stitching. However, edges 24 and 34 could also be sealed by sewing. If the bags were made, filled and sealed in a manufacturing facility, edges 24 and 34 could easily be sealed by sewing. However, if the sections to be filled are not filled and sealed until they are used in the field, sewing would be highly impractical and sealing one edge 24, 34 of each bag in the field, by an adhesive, is much easier and faster than any of the other stated methods. Speed in filling, sealing and putting the bags in place, when they are filled in the field at the site of an emergency situation, is essential.

Figure 6:
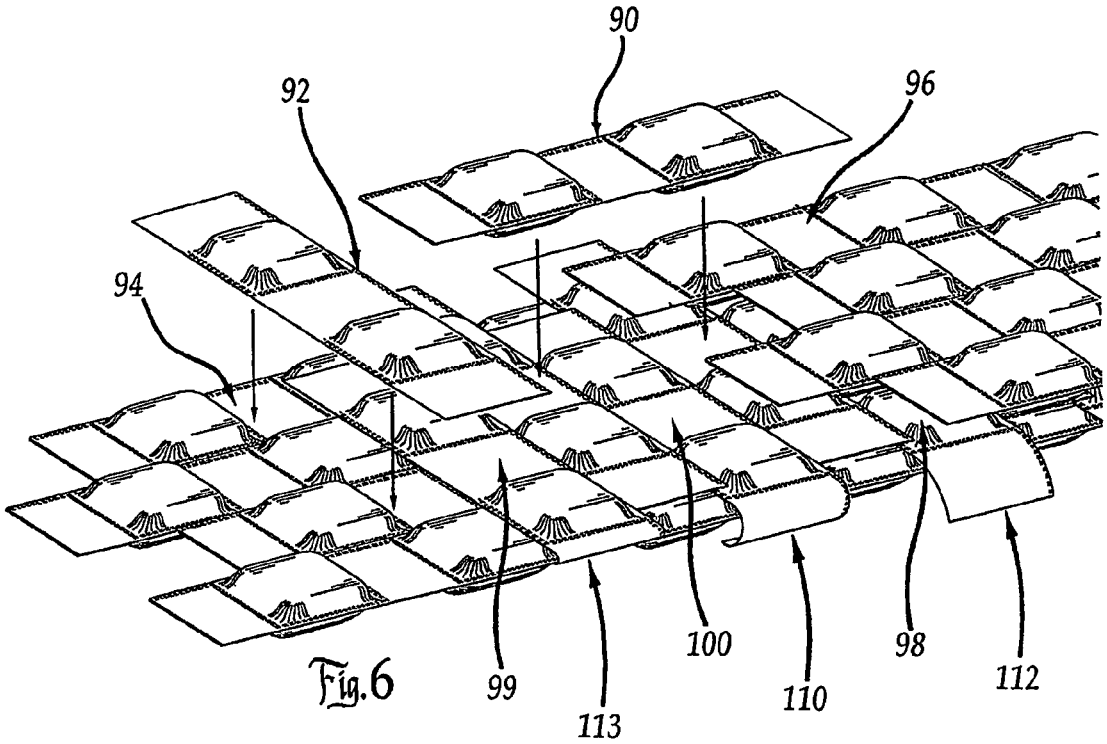
FIG. 6 is a perspective view of the transverse stacking of the bags.
Figure 7:
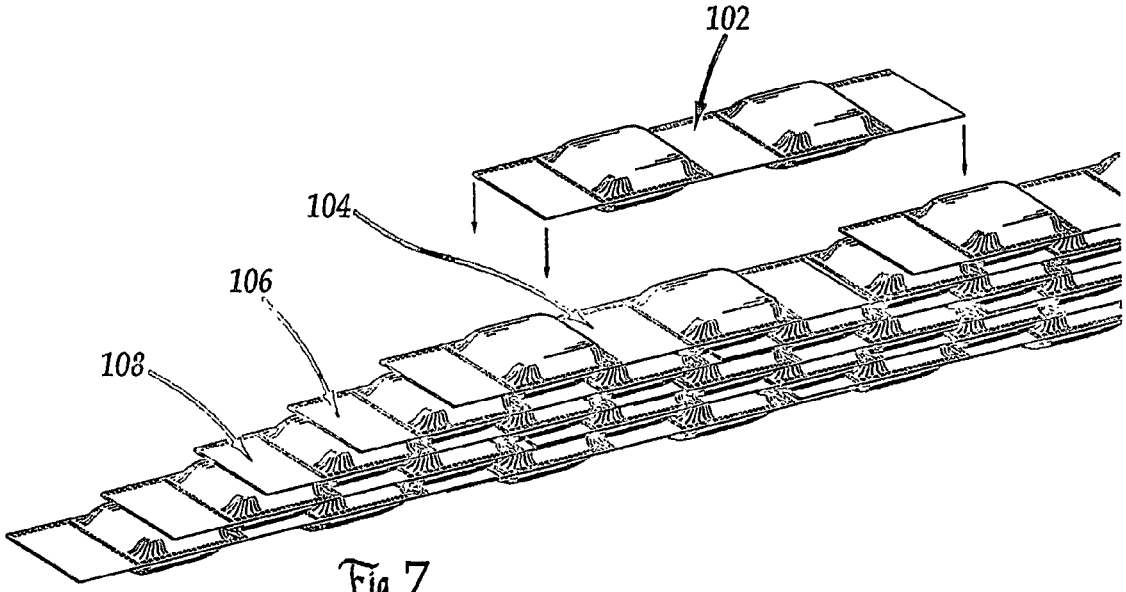
FIG. 7 is a perspective view of the parallel stacking of the bags.

The filled sections, 14 and 18, preferably have slanted sides, 54, 56, 58 and 60, and 62, 64, 66 and 68. As can be seen in FIGS. 6 and 7, the slanted sides of each filled section will fit together quite tightly, to provide a substantially water-tight structure. The angle of the slanted sides can vary from about 30 degrees to about 40 degrees, with 35 degrees being optimal. However, the exact angle is not crucial, because the bags are self-conforming.

Figure 4:
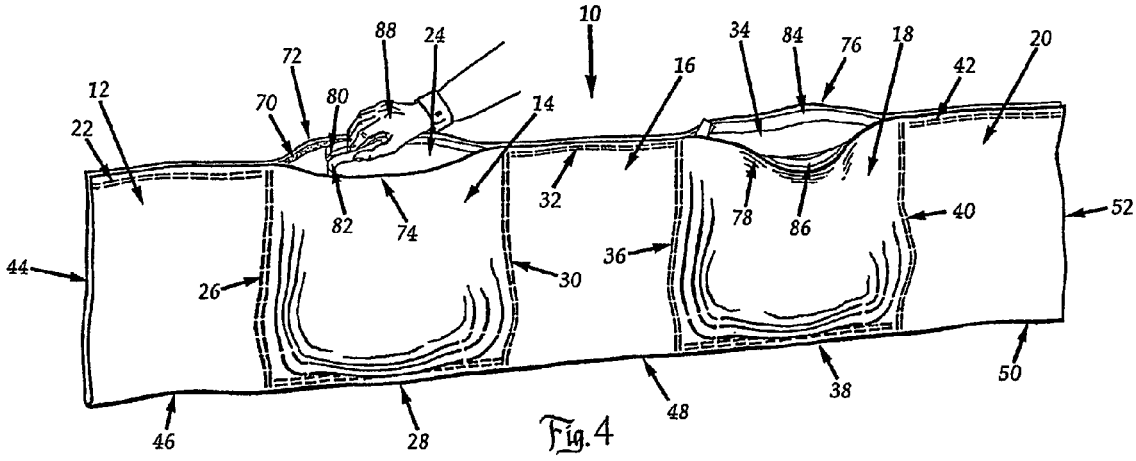
FIG. 4 is a perspective view of the field-fillable bags.

FIG. 4 shows the field-fillable bag unit shown in FIGS. 1-3, where the fillable sections have been filled with sand, or other material, and are ready to be sealed. The bag unit is divided into five sections, 12, 14, 16, 18 and 20, as shown in FIGS. 1-3. Sections 14 and 18 are fillable through open sides 24 and 34. Sides 24 and 24 are left unsealed, so that they can be filled in the field, or at any other location desired. A narrow strip of pressure sensitive adhesive 70 is applied to the inside surface of the two edges 72, 74 and 76, 78 of open sides 24 and 34. Over each of the narrow adhesive strips is placed a peel-off strip 80, 82, 84 and 86. After the open bags 14 and 18 are filled with sand, or any other material desired, peel-off strips 80, 82, 84 and 86 are peeled off by hand 88, FIG. 4, exposing the pressure sensitive adhesive, the open edges of bag sections 14 and 18 are pressed together, FIG. 5, and the bag is sealed. The pressure sensitive adhesive used is any adhesive with good adhesive power such as Chief #290-HP Hot-Melt PSA, or 3M™ #350 High-Holding Acrylic PSA. The peel-off strips are preferably made from silicone-impregnated or polyethylene-coated papers, or any other non-stick material.

Figure 5:
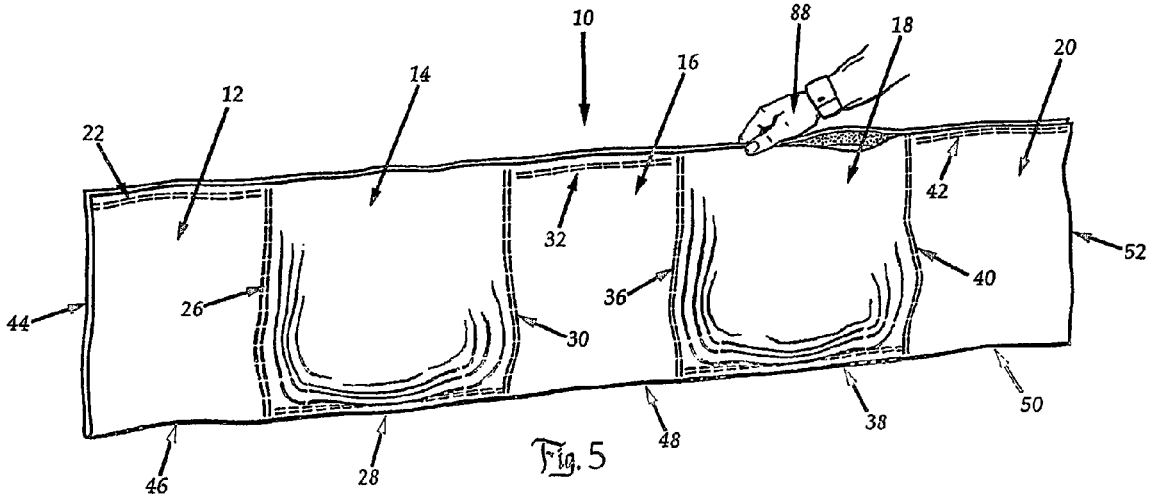
FIG. 5 is a perspective view of the sealing of the bags.

FIG. 4 depicts a person's hand 88 removing peel-off strips 80 and 82 from section 14, after it has been filled with sand, or other material. FIG. 5 depicts a person's hand 88 squeezing the two open edges 76 and 78 of section 18, sealing those edges, having a pressure sensitive adhesive, together.

FIG. 6 shows a plurality of bag units, including bag units 90, 92, 94, 96, 98, and 100 each having alternating sections of two filled sections and three unfilled sections, in which the bag units are stacked in a transverse direction to provide a wide structure when that is desired.

The bag units, for example 92, are placed so that each filled section lays over an unfilled section, see bag unit 94. The bag units that are the outer edge of the stacked bag units will have an unfilled end section, such as section 110 of bag unit 100 and section 112 of bag unit 98, which are hanging out. These unfilled end sections may be left hanging or may be folded under the adjoining filled section, as seen in unfilled end section 113 of bag unit 99.

FIG. 7 shows the more traditional stacking of bag units, including bag units 102, 104, 106 and 108 in a parallel direction. As the bag units are stacked to create a wall, each filled section is alternately placed upon an unfilled section and each unfilled section is placed on a filled section. Due to the slanted four corners, such as 54, 56, 58, and 60 of each filled section, the bag units fit tightly together in a web connection, to provide a greater frictional coefficient and hence a stronger assemblage.

The alternating sections of the bag units of this invention also provide a convenient way for men to carry the bags to a needed site, as they can be thrown over the shoulder, with the middle unfilled section upon the shoulder and two filled sections with the two unfilled end-flaps hanging down. The bags are shown with only two filled sections, since that is the easiest for a man to carry due to weight, however the bags could have more than two filled sections, depending upon their size and filled weight. The bags could also have a plurality of filled sections if they are to be carried and put in place by machine.

Any number of interlocking bag units can be stacked, depending upon the size, height and length of the wall desired to be built. Sand is usually used to fill the bags, but other materials, such as earth, concrete, aggregate or particulate matter can be used. The bag units can be any size, however for manual use the optimum size of each section is from about one foot square on each side to about 18 inches on each side. A one foot square on each side bag section having two sections filled with sand and three unfilled sections, will weigh about 40 pounds. An eighteen inch square bag, having two sections filled with sand and three unfilled sections, will weigh about 80 pounds.

After careful field studies using prototypes with a single end-flap, it was determined that there were limitations with regard to stacking possibilities and arrangements when only a single end-flap was available. With the addition of an extra end-flap, the bags became 'reversible' or 'bi-directional' rather than 'uni-directional', with increased variations possible with regard to stacking arrangements. Considerably less time was spent in the actual arranging or stacking of these modified sandbags, as less thought or consideration was needed regarding the position and placement of each unit.

It was also determined that the increase in square-inches of available interlocking-surface-area (the extra end flap) directly increased the overall strength of the final, assembled structures which were constructed using this modification.

This modification (the extra end flap) still allows for automated methods to be used to manufacture, form, fill & seal the product, however there is a great need for a 'field-fillable' sandbag, one which may be filled and sealed on-site, wherever sandbags may be needed. Tests showed that the least complicated and most satisfactory method for sealing sandbags in the field, was accomplished by applying a 'pressure-sensitive-adhesive' or 'PSA' to both, opposing surfaces along the opening of each fillable section or "pouch". This adhesive is then covered with a protective-release-paper or 'peel-off-strip,' which prevents premature adhesion of the mating surfaces until needed, and helps to prevent contamination of the adhesive surface until time of use. Other methods of closure of the sandbags, such as zippers, hook & loop (Velcro) strips, interlocking-ribbed-plastic (Ziploc-type) stripes were also functional.

INDUSTRIAL APPLICABILITY

The sandbags of this invention are usable in any situation where it is necessary to stop the flow of water, or any other liquid. In case of floods, rivers running over their banks, broken dams or broken water mains, or chemical fluid spills, it is often desired to built a sandbag wall to block and stop the flow of the liquid. The sandbags of this invention are also usable in any situation where it is necessary to create a barrier against the movement of dry earth, sand or any other material as a retaining wall. The sandbags of this invention are usable as well for many military applications, where it is necessary to protect against gunfire, explosive blasts, flying shrapnel, etc. For such military purposes, these sandbags may also be fabricated from a wide variety of heavy-duty materials, such as but not limited to, ballistic nylon or woven organic fibers, such as Kevlar™ to provide an even higher level of protection against penetration. The sandbags of this invention may be prefilled and brought to the site of use or may be filled at the site. While the bags herein are generically called "sandbags" they may actually be filled with a variety of fillers including, but not limited to, earth, sand, concrete, aggregate, or particulate matter, or a combination of any of the above.

We claim:

1. A bag adapted to be filled in the field and stacked in layers to provide a barrier comprising, a length of material having a plurality of alternating sections, wherein one section is filled with a particulate material and the adjoining section is unfilled, in which there is an unfilled section at both ends of the bag and in which each section to be filled is open with means to seal the opening after it has been filled.

2. The bag of claim 1 in which the stacked layers of bags provide a barrier against the flow of liquids, water, earth, mud, silt, explosive blasts, gunfire or shrapnel.

3. The bag of claim 1 in which the filled sections are filled with sand, earth, concrete, aggregate, or particulate matter.

4. The bag of claim 1 in which each bag has two filled sections and three unfilled sections.

5. The bag of claim 1 in which the material is woven polyethylene, woven polypropylene, burlap, canvas, ballistic nylon or woven organic fibers.

6. The bag of claim 1 in which each filled section has four slanted sides.

7. The bag of claim 6 in which the sides are slanted at an angle of from about 30 degrees to about 40 degrees.

8. A bag adapted to be filled in the field and be stacked in layers to provide a barrier comprising a length of material having alternating sections, each section having four sides, wherein one section is to be filled with a particulate material and the next adjoining section is unfilled, with unfilled sections at both ends of the bag, in which one side of each section to be filled is open with means to seal the open side after it has been filled.

9. The bag of claim 8 in which the stacked layers of bags provide a barrier against the flow of liquids, water, earth, mud, silt, explosive blasts, gunfire or shrapnel.

10. The bag of claim 8 in which each bag has two filled sections and three unfilled sections.

11. The bag of claim 8 in which the material is woven polyethylene, woven polypropylene, burlap, canvas, ballistic nylon or woven organic fibers.

12. The bag of claim 8 in which the means to seal the fillable sections comprises an adhesive on the inner edges of each open side.

13. The bag of claim 12 in which the adhesive has peel-off strip covering the adhesive.

14. A method for forming a sandbag structure in the field comprising, transporting a plurality of sandbags to the field, each sandbag comprising a length of material having alternating sections, wherein one section is open with means to seal the opening and the next adjoining section is unfilled, with unfilled sections at both ends of each sandbag, filling each open section with sand, sealing it and stacking the sandbags in layers.

15. The method of forming a sandbag structure of claim 14 in which each bag has two filled sections and three unfilled sections.

16. The method of forming a sandbag structure of claim 14 in which the material is woven polyethylene, woven polypropylene, burlap, canvas, ballistic nylon or woven organic fibers.

17. The method of forming a sandbag structure of claim 14 in which each filled section has four slanted sides.

18. The method of forming a sandbag structure of claim 17 in which the sides are slanted at an angle of from about thirty to about forty degrees.

19. The method of forming a sandbag structure of claim 14 comprising stacking the sandbags in a parallel direction.

20. The method of forming a sandbag structure of claim 14 comprising stacking the sandbags in both a parallel and a transverse direction.

* * * * *